US011671768B2

(12) United States Patent
Lim et al.

(10) Patent No.: US 11,671,768 B2
(45) Date of Patent: Jun. 6, 2023

(54) HEARING AID HAVING TWO INTERCONNECTED PARTS

(71) Applicant: Sivantos Pte. Ltd., Singapore (SG)

(72) Inventors: Elson Lim, Singapore (SG); Ravikumar Badiger, Singapore (SG); Trung Le, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/372,601

(22) Filed: Jul. 12, 2021

(65) Prior Publication Data

US 2022/0021984 A1 Jan. 20, 2022

(30) Foreign Application Priority Data

Jul. 16, 2020 (DE) ..... 102020208897.7

(51) Int. Cl.
*H04R 25/00* (2006.01)

(52) U.S. Cl.
CPC ..... *H04R 25/48* (2013.01); *H04R 25/607* (2019.05); *H04R 2225/0213* (2019.05)

(58) Field of Classification Search
CPC ..... H04R 25/48; H04R 25/60; H04R 25/607; H04R 2225/0213; H04R 2225/021; H04R 2225/0216; H04R 1/105; H04R 1/10; H04R 1/1066
USPC ..... 381/312, 330, 381, 328, 322
See application file for complete search history.

(56) References Cited

U.S. PATENT DOCUMENTS

| | | | | |
|---|---|---|---|---|
| 4,564,955 | A * | 1/1986 | Birch | H04R 25/65 381/322 |
| 6,009,183 | A | 12/1999 | Taenzer et al. | |
| 8,693,718 | B2 | 4/2014 | Agustiar et al. | |
| 2008/0002848 | A1 | 1/2008 | Heerlein et al. | |
| 2012/0148079 | A1* | 6/2012 | Gabathuler | F16B 35/06 381/330 |
| 2018/0343528 | A1 | 11/2018 | Karlsen et al. | |

FOREIGN PATENT DOCUMENTS

| | | | |
|---|---|---|---|
| DE | 102006029819 | A1 | 1/2008 |
| EP | 1874093 | A2 | 1/2008 |
| EP | 2278826 | B1 | 7/2019 |

* cited by examiner

*Primary Examiner* — Ahmad F. Matar
*Assistant Examiner* — Sabrina Diaz
(74) *Attorney, Agent, or Firm* — Laurence A. Greenberg; Werner H. Stemer; Ralph E. Locher

(57) ABSTRACT

A hearing aid, in particular a BTE hearing aid, includes a base part and an ear hook which can be attached to the base part. In an assembled state, the base part and the ear hook are connected by a nozzle and a receptacle. A sound channel runs through the nozzle. The nozzle has a circumferential outer wall and the receptacle has a circumferential inner wall. In the assembled state, a circumferential sealing ring having a thickness is disposed between the outer wall and the inner wall. The sealing ring lies in particular in an annular groove and the inner wall preferably has two reduction sections which compress the sealing ring.

15 Claims, 3 Drawing Sheets

HEARING AID HAVING TWO INTERCONNECTED PARTS

CROSS-REFERENCE TO RELATED APPLICATION

This application claims the priority, under 35 U.S.C. § 119, of German Patent Application DE 10 2020 208 897.7, filed Jul. 16, 2020; the prior application is herewith incorporated by reference in its entirety.

BACKGROUND OF THE INVENTION

Field of the Invention

The invention relates to a hearing aid, and more particularly to a hearing aid having a base part and a second part attachable thereto. More specifically, the invention relates to a BTE hearing aid with a base part and an ear hook.

Hearing aids generally have a base part with a housing in which a microphone, a signal processing unit with an amplifier and, in some hearing aid types, especially in a BTE hearing aid, a receiver are disposed. Furthermore, a battery is typically provided for power supply. An acoustic sound signal is detected by the microphone, converted by it into an electrical input signal and processed by the signal processing unit in accordance with a personal hearing deficit of the hearing aid wearer, for example amplified depending on the frequency, and delivered to the receiver as an electrical output signal, which converts it back into an acoustic sound signal that is output to the hearing aid wearer. For that purpose, the receiver has a sound output to which a sound channel is connected.

In the case of a behind-the-ear (BTE) device, the base part, specifically its housing, is connected to a so-called ear hook, with the help of which the hearing aid can be hung on the auricle of the hearing aid wearer. The ear hook itself has an acoustic sound channel which is connected to the sound channel of the base part. At its end facing away from the base part, the ear hook typically has an ear piece which is placed in the ear canal of the hearing aid wearer.

When connecting the base part to the second part, especially to an ear hook in a BTE hearing aid, a soundproof connection of the sound channels is of particular importance. If the connection is faulty, disturbing noises, for example feedback, can occur during operation, for example when acoustic output signals from the receiver return to the microphone. That manifests itself, for example, in an undesirable whistling sound.

European Patent EP 2 278 826 B1, corresponding to U.S. Pat. No. 8,693,718, describes a BTE hearing aid in which a sleeve is provided as a flexible locking device for the soundproof connection between an earpiece outlet and a sound tube connected thereto, which sleeve is partially slid over the earpiece as well as the connected sound channel.

European Patent Application EP 1 874 093 A2, corresponding to U.S. Patent Application Publication No. 2008/0002848, describes a BTE hearing aid in which a receiver tube is connected to a connector in a soundproof manner by using a plug-in connection, in that the connector has a projection which engages in the inner wall of the receiver tube and holds it on the connector.

BRIEF SUMMARY OF THE INVENTION

It is accordingly an object of the invention to provide a hearing aid, which overcomes the hereinafore-mentioned disadvantages of the heretofore-known hearing aids of this general type and which ensures a soundproof connection of a sound channel of a base part with a sound channel of a second part. In particular, it is an object of the invention to ensure a soundproof connection between a sound outlet of a base part and a sound channel of an ear hook attached to the base part.

With the foregoing and other objects in view there is provided, in accordance with the invention, a hearing aid with a base part and a second part attachable thereto, in particular a BTE hearing aid with a base part and an ear hook which is attachable to the base part. In the assembled state, i.e. when the ear hook is attached to the base part, the base part and the second part are connected to each other through connecting parts. These connecting parts are a nozzle and a receptacle constructed in the manner of a bushing, into which the nozzle can be inserted. The nozzle and the receptacle each form end sections of the respective sound channel of the base part and the second part. The nozzle and the receptacle extend along a center axis in the longitudinal direction. Along the longitudinal direction, the nozzle can be inserted with its front end into the receptacle. The nozzle and the receptacle each have a wall, namely the nozzle has a circumferential outer wall and the receptacle has a circumferential inner wall. In order to ensure a reliable soundproof seal between the nozzle and the receptacle and thus between the two sound channels, a circumferential sealing ring, specifically a so-called O-ring, is disposed between the outer wall and the inner wall in the assembled state. The sealing ring has a defined thickness and is compressed by the opposing walls in the assembled state. This means that the O-ring is compressed by the walls in the radial direction, i.e. transverse or perpendicular to the longitudinal direction.

Therefore, for sealing purposes, an additional sealing element, namely the sealing ring, is disposed around the circumference of the nozzle. This sealing element is compressed so that it is thus clamped between the two walls, thereby ensuring a reliable seal so that sound cannot escape between the two walls.

Typically, a receiver with a sound outlet nozzle for emitting acoustic sound signals is disposed in the base part. The hearing aid is in particular a hearing aid in which a signal processing unit with an integrated amplifier is disposed in the base part. The signal processing unit amplifies an electrical input signal in each case individually according to a user-specific hearing deficit and outputs the processed signal to the receiver, which converts this electrical output signal into an acoustic sound signal.

Furthermore, an annular groove with a groove bottom is formed in one of the walls, in which the sealing ring is inserted. The opposite wall, referred to below as the other wall, is at a radial distance from the groove bottom.

The radial distance is generally understood to mean a distance—viewed perpendicular to the longitudinal direction/center axis—between a respective wall section of the wall and the groove bottom. The radial distance is therefore the distance between the respective wall section and the groove bottom in a projection plane, viewed in a projection in the longitudinal direction of the respective wall section and the groove bottom in a common plane, namely with a configuration of the nozzle and the receptacle concentric to the center axis. The receptacle and the nozzle are cylindrical components, each of which extends along a center axis.

It is further provided that the other wall has a (first) reduction section by which the radial distance is reduced in the longitudinal direction and the sealing ring is compressed in the radial direction by the first reduction section when the nozzle is inserted into the receptacle. The other wall further has a compression section against which the compressed seal abuts in the assembled state. Thus, the compression section is generally understood to be the wall section which, in the assembled state, directly abuts the sealing ring and compresses it in the radial direction.

In the assembled state, the reduction section is typically guided at least partially or completely over the sealing ring in the longitudinal direction. That is, when the nozzle is inserted into the receptacle, the reduction section slides over the sealing ring, thereby compressing the sealing ring. In one embodiment, for example, the reduction section is guided completely over the sealing ring in the longitudinal direction, so that in the assembled state it remains longitudinally downstream of the sealing ring and is not part of the compression section. According to another embodiment, the reduction section remains in the section of the sealing ring in the assembled state and is thus part of the compression section.

The reduction section is preferably not an end face such as an insertion slope. Rather, another wall section, which preferably runs parallel to the longitudinal direction, adjoins the reduction section in the direction of a front end of the nozzle or the receptacle. In the case of the nozzle, the end face is the front end in the longitudinal direction, and in the case of the receptacle, the end face is the rear end opposite the longitudinal direction.

Due to the special construction of the first reduction section, the other wall thus exhibits a change in diameter. In the case of an outer wall, the diameter increases, and in the case of an inner wall, the diameter decreases, so that in each case the distance to the opposite wall is reduced. These measures ensure that when the nozzle is inserted into the receptacle, the sealing ring is successively and thus increasingly compressed. The reduction section therefore extends over a certain length and, in particular, is oriented obliquely with respect to the longitudinal direction. In particular, the first reduction section is constructed in the manner of a cone.

The construction with the annular groove, in particular also with the first reduction section, ensures a good fit of the sealing ring at the desired position when the two connecting parts (nozzle and receptacle) are joined. In particular, the construction of the reduction section ensures that a radial contact pressure is exerted which presses the sealing ring into the annular groove and thus counteracts the sealing ring being pressed out against the longitudinal direction.

The annular groove is preferably formed on the nozzle and the reduction section on the receptacle. The reverse construction is also possible in principle. Furthermore, the nozzle is preferably part of the base part and the receptacle is part of the second part. In this case, too, the reverse embodiment is possible. The other wall is therefore in particular the inner wall of the receptacle. Insofar as individual functions and preferred structures are described below on the basis of this specific construction variant with the annular groove in the outer wall of the nozzle of the base part, these explanations also apply in general to other correspondingly construction variants in which, for example, the walls are interchanged with regard to their functions.

In a preferred embodiment, a second reduction section is formed longitudinally downstream of the first reduction section, which reduces the distance in addition to the reduction by the first reduction section. This measure achieves an improved sealing effect due to the additional compression. At the same time, an additional measure is taken to prevent the sealing ring from being pressed out of the annular groove. The quasi-two-stage construction with the two reduction sections separated from each other in the longitudinal direction makes it possible for a moderate compression to be exerted initially through the first reduction section and thus also a low axial force acting against the longitudinal direction, which acts on the sealing ring. When the second reduction section reaches the sealing ring during further insertion of the nozzle into the receptacle, the sealing ring is already pressed against the groove bottom with a certain radial force and further compression by the second reduction section takes place without the risk of the sealing ring being forced out of the annular groove.

The second reduction section, like the first reduction section, therefore leads to a change in diameter, in particular to a reduction in the diameter of the inner wall of the receptacle. Preferably, there is a continuous, successive change in the diameter and thus a successive reduction in the radial distance. The second reduction section therefore preferably also runs obliquely to the longitudinal direction and is conical in shape, for example.

Preferably, both reduction sections are conical. In particular, they are of the same construction, i.e. they have, for example, the same shape. In particular, this means that they have the same cone angle. Alternatively to a similar construction, the reduction sections have different contours or profiles. For example, for the first reduction section, a conical construction is provided and the second reduction section is formed by a step in the wall, which leads to a jump in the change in distance. An oblique course is understood to mean, in particular, a linear course. In addition, it is also possible for the respective wall in the area of the reduction section to be curved, i.e. rounded, or to have multiple steps.

In a preferred embodiment, an intermediate section of the other wall is formed between the two reduction sections, which is referred to as the second wall section. This intermediate section therefore separates the two reduction sections from each other. The intermediate section runs in particular parallel to the center axis. Furthermore, in a preferred embodiment, the intermediate section is part of the compression section. I.e. in the assembled state, the intermediate section is in contact with the sealing ring.

Furthermore, a third wall section adjoins the second reduction section in the longitudinal direction, which is part of the compression section and is oriented in particular parallel to the center axis.

Generally, in a preferred embodiment, the second reduction section is part of the compression section, and therefore lies against the sealing ring in the assembled state. In a preferred embodiment, the aforementioned wall sections, which run parallel to the center axis, adjoin this second reduction section on both sides. Since these are also part of the compression section in a preferred embodiment, the compression section as a whole has a profiled course, in particular a stepped course, so that in the assembled state the sealing ring is compressed to different degrees at different sections (viewed in the longitudinal direction). As a result, the individual wall sections, namely the second and third wall sections and the wall section in the area of the second reduction section, are formed as individual sealing surfaces that ensure a particularly effective soundproof seal.

In a preferred embodiment, the first reduction section is not part of the compression section. This means that when the nozzle is inserted into the receptacle, the first reduction section is completely guided over the sealing ring. Therefore, in the embodiment with two reduction sections, preferably only the first reduction section is part of the compression section. The preferred embodiment is the embodiment with at least two and in particular with exactly two reduction sections. Reduction sections are generally defined as wall sections in which the radial distance is reduced.

In a preferred embodiment, the other wall has a first wall section—seen opposite to the longitudinal direction—in front of the first reduction section, which has a radial distance from the groove bottom that is greater than the thickness of the sealing ring. As a result, no compression of the sealing ring takes place in the area of this first wall section when the nozzle is inserted into the receptacle. Rather, the dimension of this first wall section is such that there is at least a slight clearance between the wall and the sealing ring. This reliably prevents axial forces from acting on the sealing ring in front of the first reduction section.

The first reduction section is preferably adjoined on both sides by wall sections running parallel to the center axis. These are the first wall section and the second wall section, which is disposed longitudinally downstream of the first reduction section.

As an alternative to the preferred embodiment with the two reduction sections, only the first reduction section is provided in a simplified embodiment. In this embodiment, the first reduction section is preferably located outside the compression section. Alternatively, it can also be located within the compression section. In the former embodiment, i.e. when the first reduction section lies outside the compression section, the second wall section following the first reduction section in the longitudinal direction forms the compression section. In particular, the second wall section runs parallel to the center axis and forms a particularly straight course of the compression section, i.e. in this embodiment, there is no stepped or other contoured configuration of the compression section.

In a preferred embodiment, the first reduction section further forms a stop which, in the assembled state, abuts against a wall section of the opposite wall, thus forming a longitudinally acting stop. This stop limits the movement of the nozzle into the receptacle in the longitudinal direction. Thus, the joined end position is precisely defined by this stop. The position of the individual wall sections, for example that of the second reduction section with respect to the sealing ring or with respect to the annular groove, is therefore also defined through this stop. Alternatively to the construction of the first reduction section as a stop, the stop is formed at another position. For example, a stop is formed by the end face of the nozzle and a corresponding annular surface of the receptacle. Furthermore, for example, a web, in particular an annular web, is formed on the nozzle or the receptacle, which limits the longitudinal movement. It is crucial that the relative end position that the two connecting parts assume with respect to each other is defined, so that the desired wall sections are disposed in the correct position.

In a useful construction, the walls each have a threaded section, the threaded sections being disposed longitudinally downstream of the annular groove. The nozzle and the receptacle are therefore connected to each other through threads by screwing. Alternatively, there are also other connection options between the nozzle and the receptacle. For example, a pure plug-in connection may be provided. In this case, measures are taken in particular to produce a positive connection acting in the longitudinal direction.

Other features which are considered as characteristic for the invention are set forth in the appended claims.

Although the invention is illustrated and described herein as embodied in a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
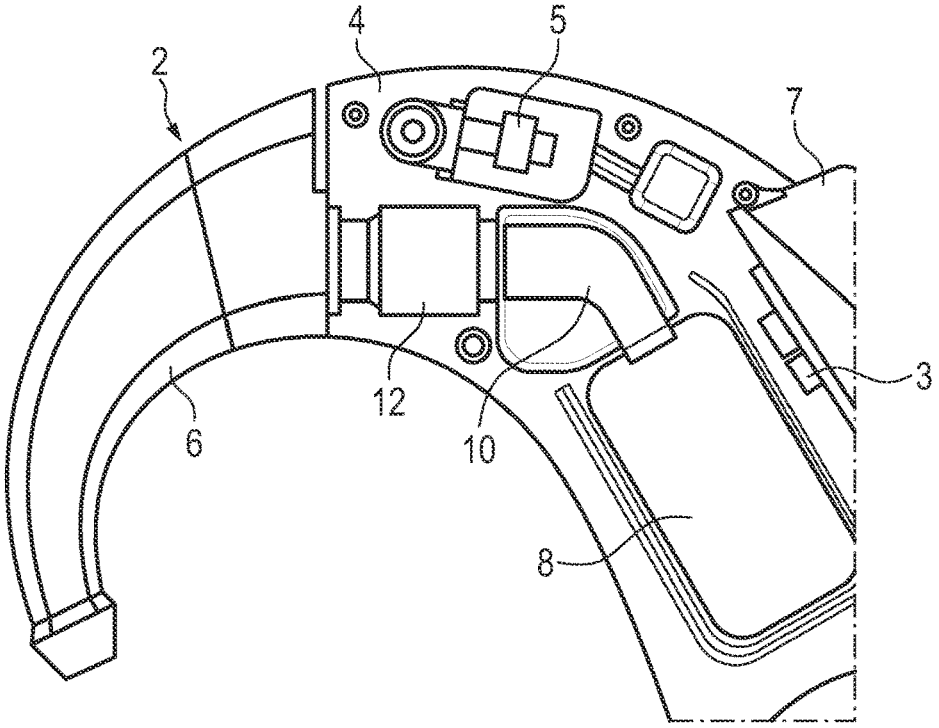
FIG. 1 is a diagrammatic, partial sectional view of a BTE hearing aid, with a base part and an ear hook connected thereto.

Referring now to the figures of the drawings in detail and first, particularly, to FIG. 1 thereof, there is seen a common BTE hearing aid 2, which has a base part 4 and an ear hook 6 attached thereto. The base part 4 has a housing in which a signal processing unit 3, a microphone 5 and a receiver 8 are disposed. Furthermore, a control element 7, for example a button or a switch, is typically disposed in the housing. The receiver 8 has a sound output nozzle to which, in the example, a sound tube 10 is attached, which in turn is connected to a connection piece 12. This connection piece 12 has a nozzle 14 at the end, which is inserted into a corresponding receptacle 16 in the ear hook 6. The nozzle 14 as well as the receptacle 16 are not visible in FIG. 1. In FIG. 1 a cover or the housing of the base part 4 is omitted so that the interior of the base part 4 is visible.

In operation, an acoustic signal is generally converted by the microphone 5 into an electrical signal, which is conditioned in the signal processing unit 3. The conditioned signal is passed to the earpiece 8, which again converts the conditioned signal into an acoustic sound signal and emits it through the afore-mentioned sound outlet port, so that sound is transmitted to an ear canal of the wearer through a sound channel typically formed in the ear hook 6 through a sound tube. The BTE hearing aid 2 is—as the name suggests—worn by the wearer behind the ear. Through the use of the ear hook 6, the hearing aid is attached to the pinna of the wearer's ear.

The nozzle 14 and the receptacle 16 are substantially cylindrical and extend along a common center axis 18 in a longitudinal direction 20. The direction of the longitudinal direction 20 is defined in this case from a rear end to a front, free end of the nozzle 14. At the same time, the longitudinal direction 20 also defines a direction of insertion for the nozzle 14 into the receptacle 16. In the front section, the nozzle 14 has a threaded section 22 which can be screwed into a corresponding threaded section 22 of the receptacle 16. For this purpose, the individual threaded sections 22 each have a helical circumferential thread.

The nozzle 14 generally has an outer wall 24 and the receptacle 16 has an inner wall 26. An annular groove 28 is formed in the outer wall 24, in which a sealing ring 30 in the form of an O-ring is located. As usual, the sealing ring is formed of an elastic material and is compressible. In the embodiment example, the annular groove 28 and thus the sealing ring 30 are disposed in front of the threaded section 22, as viewed in the longitudinal direction. The annular groove 28 is open to one side in the radial direction and has a groove bottom 29 opposite the opening.

Figure 2:
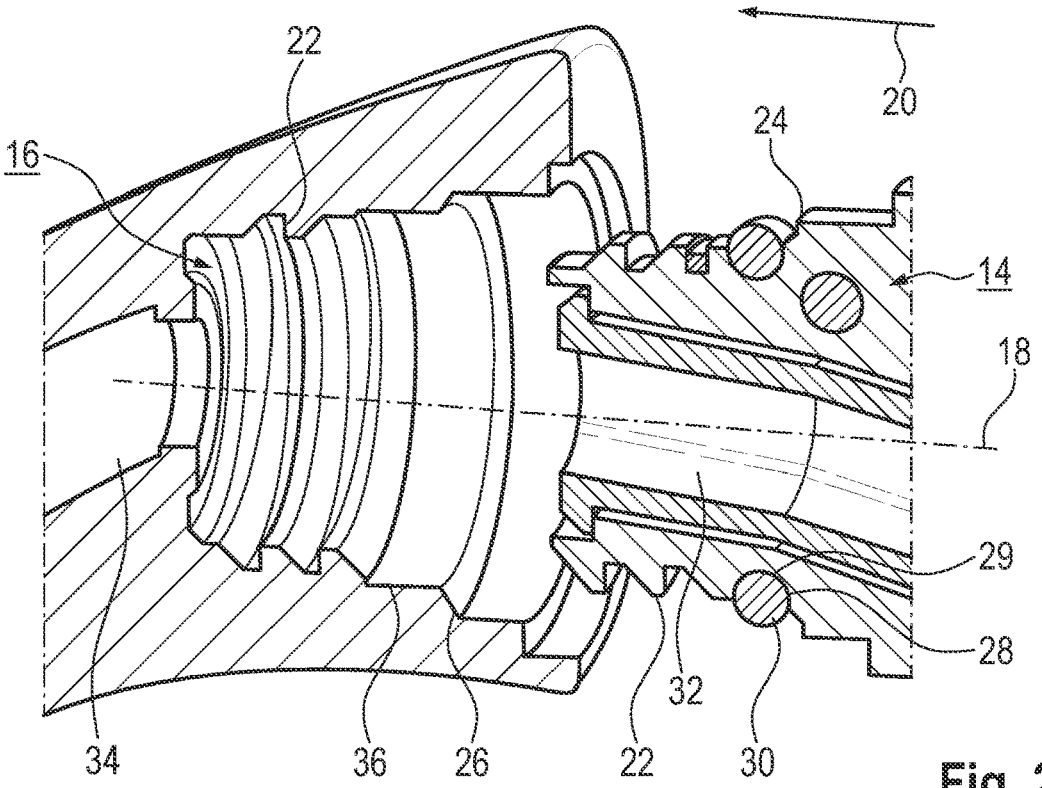
FIG. 2 is a partial perspective view in the connection area between the base part and the ear hook in an initial situation, before insertion of a nozzle of the base part into a receptacle of the ear hook.

The nozzle 14 has a sound channel 32 on the inside. An end of a sound tube, for example, is inserted in an inner cavity of the nozzle 14, as shown in FIG. 2. This sound tube defines the sound channel 32, which is continued on the side of the ear hook 6 in a further sound channel 34. For this purpose, another sound tube is connected to the receptacle 16, for example.

Through the use of the sealing ring 30, a soundproof connection between the receptacle 16 and the nozzle 14 is ensured. In general, the sealing ring 30 is compressed during assembly in the radial direction, i.e. perpendicular to the longitudinal direction 20, so that it is pressed in between the inner wall 26 and the outer wall 24.

For the sealing effect, the highest possible compression would be desirable in order to ensure a completely circumferential seal. At the same time, however, there is a risk with high compression that the sealing ring 30 will be forced out of the annular groove 28 against the longitudinal direction 20 when the nozzle 14 is inserted into the receptacle 16.

In order to both achieve a good sealing effect and also prevent the sealing ring 30 from being pressed out, special measures are provided which are explained below with reference to FIGS. 2 to 5.

The inner wall 26 has a first reduction section 36, which is in particular conical in shape. This first reduction section 36 is thus oriented obliquely to the longitudinal direction 20 and has an angle of inclination a (cone angle) to the latter, which lies, for example, in the range between 20° and 70° and, in particular, in the range between 30° and 60°. In the longitudinal direction 20, the first reduction section 36 extends, for example, over a length corresponding to between 10% and 40% of a thickness d of the sealing ring 30.

In a direction opposite to the longitudinal direction 20, a first wall section 38 adjoins the first reduction section 36—in the example forming a step-shaped jump. In the longitudinal direction 20, the first reduction section 36 is followed by a second wall section 40, which runs parallel to the center axis 18.

The respective wall section or the respective wall sections that abut the sealing ring 30 in the assembled final state define a compression section 42.

Figure 3:
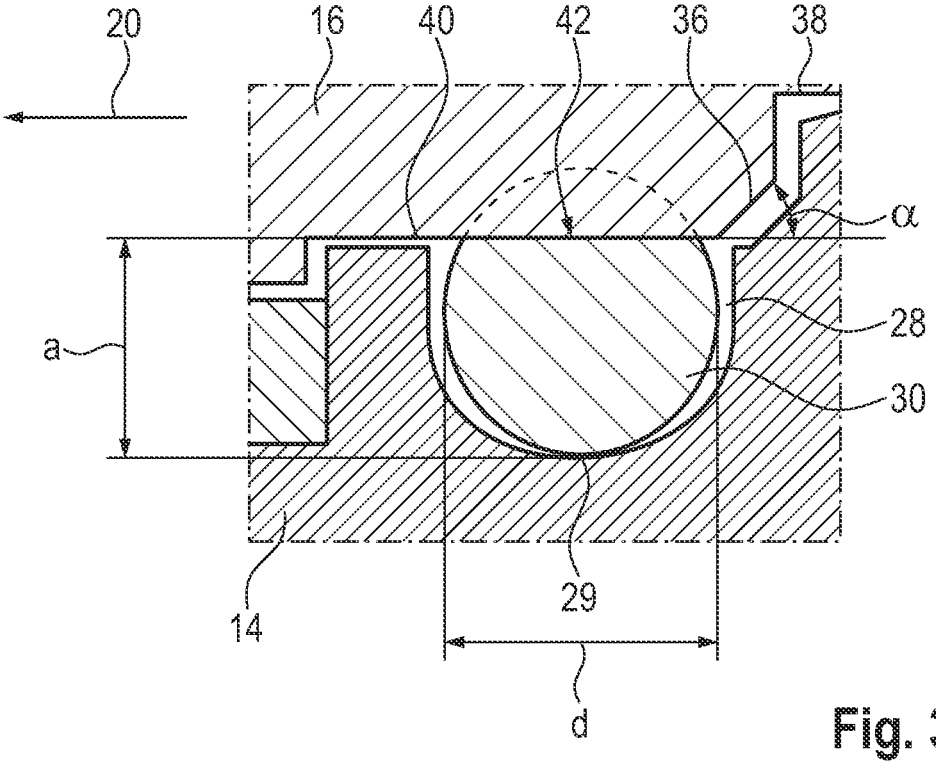
FIG. 3 is an enlarged sectional view of the nozzle and the receptacle in the area of a sealing ring according to a first embodiment with only one reduction section.

In the example of FIG. 3, the compression section 42 is formed by the second wall section 40. Compression of the sealing ring 30 also generally results in deformation thereof, so that generally the annular groove 28 and thus the intermediate section between the nozzle 14 and the receptacle 16 is reliably filled and sealed.

In principle, a larger, in particular thicker sealing ring 30 would lead to an improved sealing effect. However, the nozzle 14 and the receptacle 16 are comparatively small parts and the available space is limited, so that the size of the sealing ring 30 is limited. High compression is also limited by the fact that when the nozzle 14 is inserted into the receptacle 16, the reduction in diameter exerts a force in opposite direction to the longitudinal direction 22, which acts on the sealing ring 30 and can push it out of the annular groove 28.

Figure 4:
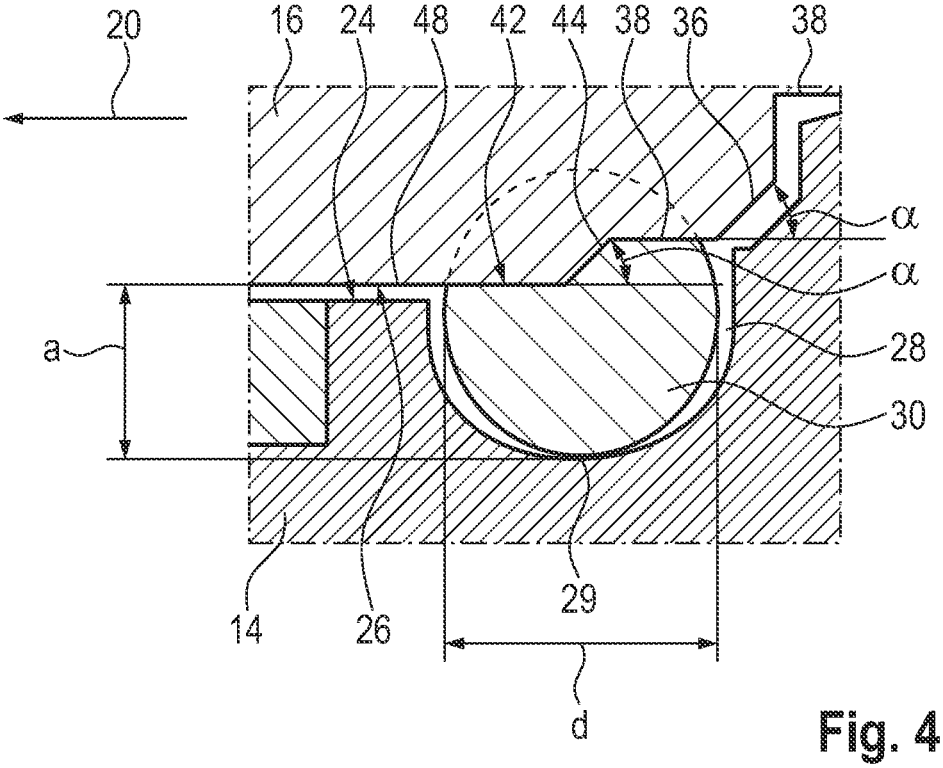
FIG. 4 is an enlarged sectional view similar to FIG. 3 of a preferred construction with two reduction sections, the second reduction section being positioned in the area of the sealing ring.
Figure 5:
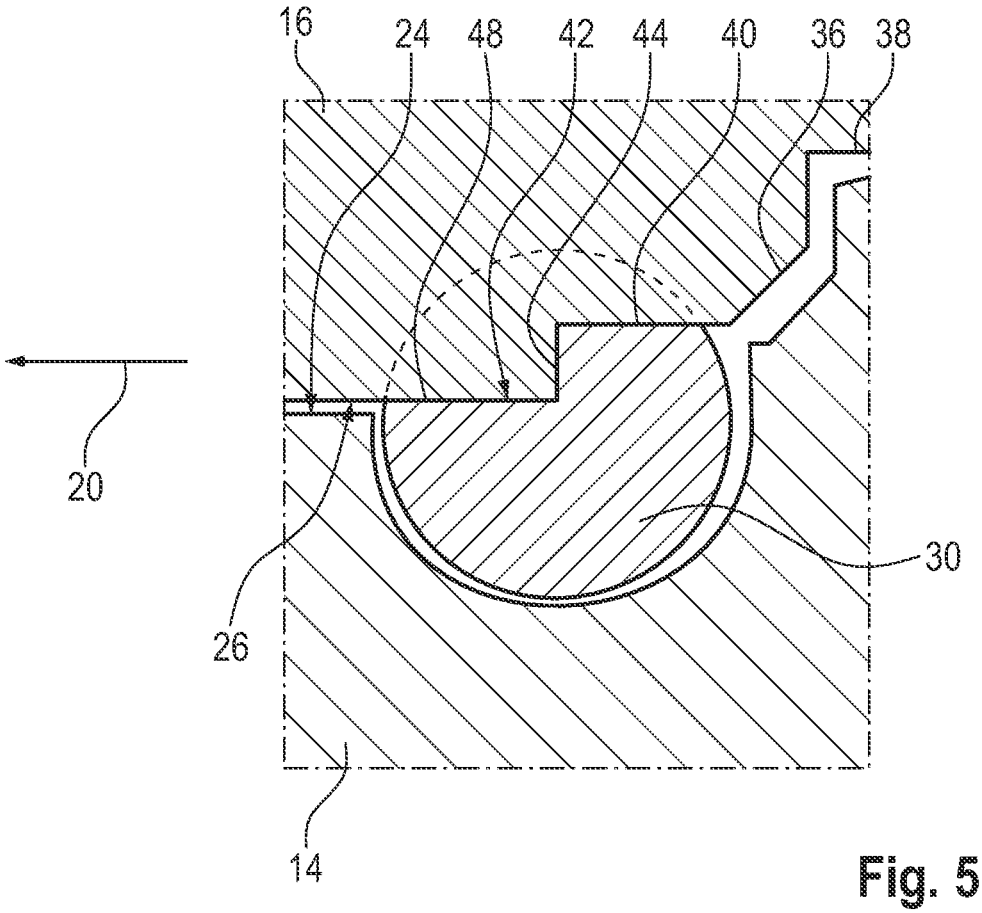
FIG. 5 is an enlarged sectional view of an alternative construction of the preferred variant with the two reduction sections.

In order to increase the sealing effect and to prevent the sealing ring 30 from being pressed out as far as possible, the improved embodiment shown in FIGS. 4 and 5 is provided.

Of particular importance, is that a second reduction section 44 is provided which results in further compression of the sealing ring 30. The reduction sections 36, 44 generally change a radial distance a between a respective wall section and the groove bottom 29.

In the example of FIG. 4, a third wall section 48 follows the second reduction section 44 in the longitudinal direction 20 and runs parallel to the center axis 18. Furthermore, it is of particular importance that in the joined final state the second reduction section 44, the leading second wall section 40 and the trailing third wall section 48 form the compression section 42. As a result, a plurality of separate sealing surfaces are formed by these different wall sections. This significantly increases the sealing effect. In particular, the second reduction section 44 enables a higher compression, since the two compression stages reduce the risk of the sealing ring 30 being pressed out. Compared to the embodiment of FIG. 3, for example, a 10% to 25% higher compression can be achieved without a higher risk of the sealing ring 30 being pushed out. Alternatively or additionally, this improved embodiment allows the use of smaller sealing rings 30 especially sealing rings 30 with a smaller thickness d.

In the example of FIG. 4, the second reduction section 44 is also conical. Its cone angle $\alpha$ is preferably in the range between 20° and 70° and in particular in the range between 30° and 60°. It preferably has the same cone angle $\alpha$ as the first reduction section 36.

In principle, there are different construction options for the profiling and contouring of the reduction sections 36, 44, especially for the second reduction section 44. For example, a stepped construction is also provided as an alternative, as shown in FIG. 5. In this case, the second reduction section 44 is oriented perpendicular to the longitudinal direction 20.

For example, the reduction of the radial distance a by the first reduction section 36 is in the range between 5% and 20% of the thickness d of the sealing ring 30. For example, the reduction of a radial distance a by the second reduction section 44 is also in the range between 5% and 20% of the thickness d. For example, the radial distance a is reduced identically or alternatively differently by the two reduction sections 36, 44.

The particular advantage of the variants described with regard to FIGS. 4 and 5 is that the profiled construction of the wall in the compression section 42 provides several sealing sections that form a redundancy. In addition, this enables increased compression, which improves the sealing effect. These variants are particularly advantageous for installation situations in which only small sealing rings 30 can be used. In the case of larger sealing rings, the special profiling reduces the risk of the sealing ring 30 being pressed out. In addition to the profiled construction of the compression section 42, it is particularly decisive for this that—when the parts are joined—the second reduction section 44 acts on the sealing ring 30 at a later time than the first reduction section 36.

During assembly, the nozzle 14 is inserted into the receptacle 16 in the longitudinal direction 20. In the variant shown in FIG. 2, this is done by screwing it in. For this purpose, the ear hook 6 with its receptacle 16 is typically screwed onto the nozzle 14. The joined end position is generally limited by a stop, through the use of which a defined relative position is assumed between the nozzle 14 and the receptacle 16, so that the individual wall sections are positioned at the desired positions relative to the sealing ring 30. Preferably, the stop is formed by the first reduction section 36, which in the assembled state comes to rest against a corresponding counter stop on the opposite wall.

The invention is explained herein in connection with embodiments of the connection between the base part 4 and the ear hook 6. In principle, the construction described herein between the receptacle 16 and the nozzle 14 with the sealing ring 30 and the special profiling of the wall can also be transferred to other constructions, especially for hearing aids, in which a soundproof connection between two components is required.

The following is a summary list of reference numerals and the corresponding structure used in the above description of the invention.

LIST OF REFERENCE SIGNS

2 BTE hearing aid
3 signal processing unit
4 base part
5 microphone
6 ear hook
7 control element
8 Receiver
10 sound tube
12 connection piece
14 Nozzle
16 Receptacle
18 center axis
20 longitudinal direction
22 threaded section
24 outer wall
26 inner wall
28 annular groove
29 groove bottom
30 sealing ring
32 sound channel
34 further sound channel
36 first reduction section
38 first wall section
40 second wall section
42 compression section
44 second reduction section
48 third wall section
a radial distance
a cone angle
d thickness

The invention claimed is:

1. A hearing aid, comprising:
a base part and a second part to be fastened to said base part;
a nozzle and a receptacle extending along a center axis in a longitudinal direction;
said nozzle being insertable into said receptacle along the longitudinal direction for interconnecting said base part and said second part in an assembled state;
a sound channel extending through said nozzle;
said nozzle having a peripheral outer wall and said receptacle having a peripheral inner wall;
a circumferential sealing ring disposed between said outer wall and said inner wall, said circumferential sealing ring having a thickness and being compressed by said outer wall and said inner wall in the assembled state;
one of said outer wall or said inner wall having an annular groove with a groove bottom formed therein;
another of said outer wall or said inner wall being disposed at a radial distance from said groove bottom;
said annular groove receiving said sealing ring;
said other of said outer wall or said inner wall having first and second wall sections and a first reduction section reducing the radial distance in the longitudinal direction, said sealing ring being compressed by said first reduction section upon said nozzle being inserted into said receptacle;
said other of said outer wall or said inner wall having a compression section, said compressed sealing ring bearing against said compression section in the assembled state;
said compression section being a wall section directly abutting and compressing said sealing ring in a radial direction in the assembled state;
said first reduction section partially or completely sliding over said sealing ring and compressing said sealing ring upon inserting said nozzle into said receptacle;
said second wall section following said first reduction section in the longitudinal direction and forming at least a part of said compression section; and
said first reduction section being guided completely over said sealing ring in the longitudinal direction, causing said first reduction section to remain longitudinally downstream of said sealing ring and not be part of said compression section in the assembled state, or
said first reduction section remaining in a section of said sealing ring and being part of the compression section in the assembled state.

2. The hearing aid according to claim 1, which further comprises a second reduction section formed downstream of said first reduction section in the longitudinal direction, said second reduction section reducing the radial distance in addition to the reduction by said first reduction section.

3. The hearing aid according to claim 2, wherein said first and second reduction sections are each conical in shape.

4. The hearing aid according to claim 2, wherein said other of said outer wall or said inner wall has an intermediate section extending between said two reduction sections as said second wall section, said intermediate section being part of said compression section.

5. The hearing aid according to claim 4, wherein said second wall section is oriented parallel to the center axis.

6. The hearing aid according to claim 2, which further comprises a third wall section adjoining said second reduction section in the longitudinal direction, said third wall section being part of said compression section.

7. The hearing aid according to claim 6, wherein said third wall section is oriented parallel to the center axis.

8. The hearing aid according to claim 2, wherein said compression section includes said second reduction section.

9. The hearing aid according to claim 1, wherein said first wall section of said other of said outer wall or said inner wall is disposed in the longitudinal direction in front of said first reduction section at a distance greater than the thickness of said sealing ring, preventing compression from occurring in a region of said first wall section.

10. The hearing aid according to claim 1, wherein said first reduction section forms a stop abutting against a wall section of an opposite wall in the assembled state.

11. The hearing aid according to claim 1, wherein said outer wall and said inner wall each include a threaded section disposed downstream of said annular groove in the longitudinal direction.

12. The hearing aid according to claim 1, wherein said annular groove is formed on said nozzle and said first reduction section is formed on said receptacle.

13. The hearing aid according to claim 1, wherein the hearing aid is a BTE hearing aid, and said second part is an ear hook.

14. The hearing aid according to claim 1, wherein said second wall section is oriented parallel to the center axis.

15. The hearing aid according to claim 1, wherein said first reduction section is not an end face or an insertion slope, and another wall section adjoins said first reduction section in a direction toward a front end of said receptacle.

* * * * *